US006121536A

United States Patent [19]

Malcolm

[11] Patent Number: 6,121,536

[45] Date of Patent: Sep. 19, 2000

[54] METHOD AND APPARATUS FOR ENCODING TEXT IN A MIDI DATASTREAM

[75] Inventor: Jerry Walter Malcolm, Austin, Tex.

[73] Assignee: International Business Machines Corporation, Armonk, N.Y.

[21] Appl. No.: 09/303,107

[22] Filed: Apr. 29, 1999

[51] Int. Cl.[7] ..... G10H 7/00

[52] U.S. Cl. ..... 84/645

[58] Field of Search ..... 84/645

[56] References Cited

U.S. PATENT DOCUMENTS

| | | | |
|---|---|---|---|
| 5,233,438 | 8/1993 | Funahashi et al. | 84/645 |
| 5,321,200 | 6/1994 | Yamamoto . | |
| 5,416,526 | 5/1995 | Yamamoto . | |
| 5,640,590 | 6/1997 | Luther . | |
| 5,675,100 | 10/1997 | Hewlett | 84/645 X |
| 5,736,666 | 4/1998 | Goodman et al. . | |
| 5,737,491 | 4/1998 | Allen et al. . | |
| 5,852,251 | 12/1998 | Su et al. | 84/645 |

*Primary Examiner*—Jeffrey Donels
*Attorney, Agent, or Firm*—Morgan & Finnegan, L.L.P.

[57] ABSTRACT

A system and method for transmitting text data to MIDI devices. Text data is received, encoded to generate a plurality of MIDI events not including a standard MIDI text event, and the generated MIDI events are transmitted. In one embodiment, the encoding includes selecting a standard type of MIDI event and generating a plurality of MIDI events of the selected type that encode the text data, the generated MIDI events being overrun events that have no effect on a musical output. In another embodiment, the encoding includes selecting a non-standard type of MIDI event and generating a plurality of MIDI events of the selected type that encode text data.

55 Claims, 8 Drawing Sheets

Fig. 2a

| STATUS D7---D0 CHANNEL VOICE MESSAGES: | # OF DATA BYTES | DESCRIPTION |
|---|---|---|
| | | |
| 1000NNNN | 2 | NOTE OFF EVENT |
| 1001NNNN | 2 | NOTE ON EVENT (VELOCITY=0: NOTE OFF) |
| 1010NNNN | 2 | POLYPHONIC KEY PRESSURE/AFTER TOUCH |
| 1011NNNN | 2 | CONTROL CHANGE |
| 1100NNNN | 1 | PROGRAM CHANGE |
| 1101NNNN | 1 | CHANNEL PRESSURE/AFTER TOUCH |
| 1110NNNN | 2 | PITCH BEND CHANGE |
| 11110000 | ***** | SYSTEM EXCLUSIVE |
| 11110SSS | 0 TO 2 | SYSTEM COMMON |
| 11111TTT | 0 | SYSTEM REAL TIME |

FIG. 2B

| META EVENTS | DESCRIPTION |
|---|---|
| | |
| FF 01 | TEXT |
| FF 02 | COPYRIGHT NOTICE |
| FF 03 | SEQUENCE/TRACK NAME |
| FF 04 | INSTRUMENT NAME |
| FF 05 | LYRIC |
| FF 06 | MARKER |
| FF 07 | CUE POINT |

METHOD AND APPARATUS FOR ENCODING TEXT IN A MIDI DATASTREAM

FIELD OF THE INVENTION

The present invention relates to a method and apparatus for encoding text in a MIDI datastream.

BACKGROUND OF THE INVENTION

The Musical Instrument Digital Interface (MIDI) is a protocol used to transmit musical instructions to a musical device or instrument that is capable of converting the instructions into musical sounds. MIDI data is transmitted over a MIDI cable to the devices. MIDI data may also be stored in an architected file format called "Standard MIDI File" (*.mid) format.

MIDI is an event-oriented protocol. There are note events, tempo events, controller events, etc. There are also standard MIDI text events that can contain text data, such as trademarks, song titles, copyright information, etc. Such standard MIDI text events are commonly stored in mid files. However, since the standard MIDI text events are for the benefit of humans, they are typically not transmitted to the musical instruments. A problem arises in that certain information, such as legal and factual information, may be separated from the musical data intentionally or unintentionally. Further, if an instrument can display text, but the device transmitting the data discards text events, the text will not be displayed. A need arises for a technique by which text data may be transmitted to MIDI devices.

SUMMARY OF THE INVENTION

The present invention is a system and method for transmitting text data to MIDI devices. Text data is received, encoded to generate a plurality of MIDI events not including a standard MIDI text event, and the generated MIDI events are transmitted. In one embodiment, the encoding includes selecting a standard type of MIDI event and generating a plurality of MIDI events of the selected type that encode the text data, the generated MIDI events being overrun events that have no affect on a musical output. In another embodiment, the encoding includes selecting a non-standard type of MIDI event and generating a plurality of MIDI events of the selected type that encode text data.

BRIEF DESCRIPTION OF THE DRAWINGS

The details of the present invention, both as to its structure and operation, can best be understood by referring to the accompanying drawings, in which like reference numbers and designations refer to like elements.

FIG. 2*a* is an exemplary format of MIDI events.

FIG. 2*b* shows a number of MIDI meta-events.

DETAILED DESCRIPTION OF THE INVENTION

Figure 1:
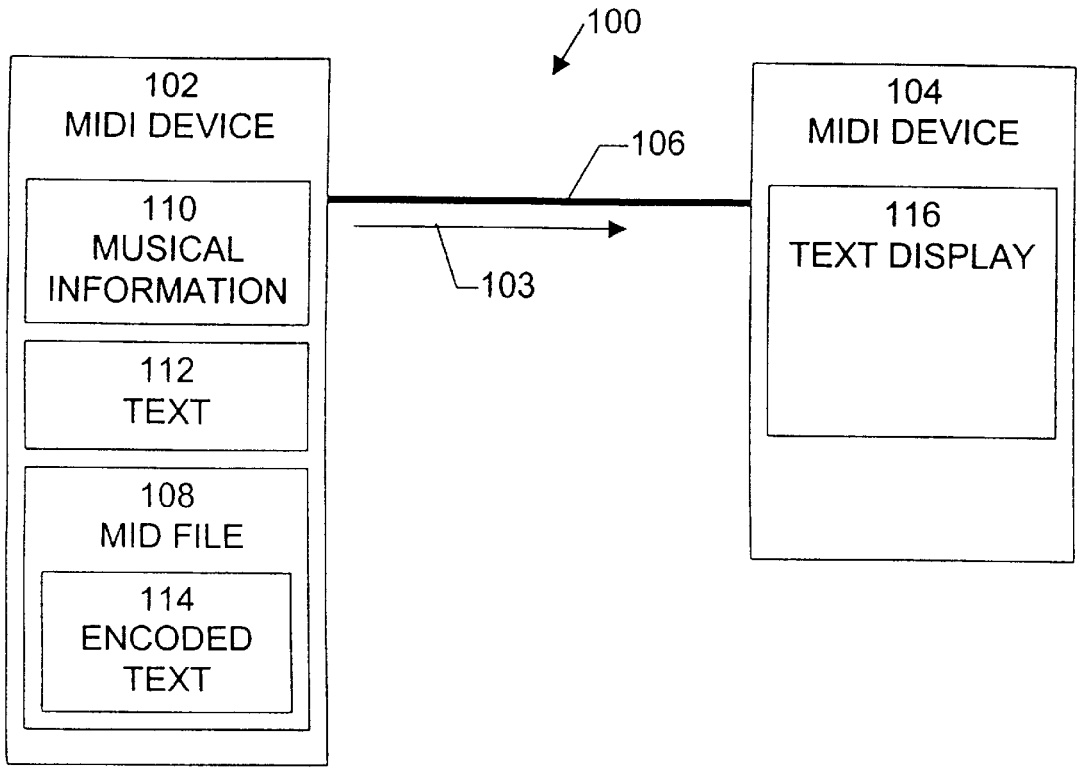
FIG. 1 shows a system including MIDI devices, according to the present invention.

An exemplary MIDI system 100, according to the present invention, is shown in FIG. 1. A MIDI device 102 outputs a MIDI datastream 103 to MIDI device 104 over MIDI cable 106. The MIDI devices 102 and 104 may be any of a number of well-known devices, such as keyboards, synthesizers, synchronizers, computer systems, etc. If the device, for example, device 102, is a personal computer, the device may store one or more files containing MIDI data. Typically, files containing MIDI data are in a Standard MIDI File (*.mid) format, such as file 108. File 108 is generated by entering musical information 110 and text 112 into MIDI device 102. The musical information 110 is converted into MIDI event information and the text 112 is encoded into MIDI event information 114 included in MIDI file 108. MIDI file 108 is transmitted to MIDI device 104 as MIDI datastream 103. MIDI device 104 receives MIDI datastream 103 and generates musical output based on the datastream. MIDI device 104 also decodes the encoded text included in the datastream and displays the text on text display device 116.

MIDI is an event-based protocol. The MIDI events relate to changes in music being output by the various MIDI devices. A MIDI datastream comprises a sequence of specifications of such events. As MIDI events relate to music, it is important that each event be performed at the correct time. Therefore, all MIDI events include a timestamp indicating the time in the musical performance that the event is to be performed. The timestamp of an event represents the time difference between that event and the previous event, rather than the absolute time at which the event is to be performed. The actual time at which an event is to be performed is calculated by adding the time difference to the time at which the previous event was performed. The timestamp is in the form "measure:beat:tick". Tick resolution is typically 1/120th of a quarter note.

The MIDI standard defines a number of types of events, as shown in FIG. 2*a*. These events control changes in the music being output by the MIDI device. As shown, there are 8 major event types in MIDI: Note On, Note Off, Key aftertouch, Control Change (commonly known as a controller event), Program or Patch Change (instrument selection), Channel aftertouch, Pitch Bend Change (Pitchwheel), and System events. Note on/off controls the start and stop of actual notes. Key aftertouch, controller, channel aftertouch, and pitchwheel affect the playing of the notes that are currently playing. System events are usually setup or meta events. Patch change events change the instrument that will be used to play the notes.

In addition to the events shown in FIG. 2*a,* the MIDI standard defines a number of other events, for example, the meta-events shown in FIG. 2*b*. Meta events 01 through 0F, are reserved for various types of text events, each of which is used to transmit text, but which is used for a different purpose, as described in Table A.

TABLE A

| META EVENTS | DESCRIPTION |
|---|---|
| TEXT | General text event, can be any text. |
| COPYRIGHT NOTICE | Contains a copyright notice as printable ASCII text. |
| SEQUENCE/ TRACK NAME | If in a format 0 track, or the first track in a format 1 file, the name of the sequence. Otherwise, the name of the track. |

TABLE A-continued

| META EVENTS | DESCRIPTION |
|---|---|
| INSTRUMENT NAME | A description of the type of instrumentation to be used in that track. |
| LYRIC | A lyric to be sung. |
| MARKER | Normally in a format 0 track, or the first track in a format 1 file. The name of that point in the sequence, such as a rehearsal letter or section name ("First Verse", etc.). |
| CUE POINT | A description of something happening on a film or video screen or stage at that point in the musical score ("Car crashes into house", "curtain opens", "she slaps his face" etc.) |

In this documents, all events that transmit text that are defined in the MIDI standard, including the above-described events, and any others defined in the MIDI standard, are termed "standard MIDI text events."

Some of the events, such as Note On and Note Off, cause changes in the music being output whenever such events occur. However, some events do not always cause changes in the musical output. For example, if a series of controller events occurs when no notes are playing, only the last event in the series will have an affect on the musical output, and then not until at least one note starts playing.

The present invention uses MIDI events that have no effect on the musical output to encode text messages and transmit the messages to MIDI devices. Any event from the set of events above that affect the playing of the current notes may be used to encode the text according to the present invention. They do not make notes play, they only affect the notes that are playing. They also typically appear in a series of incrementing or decrementing values to provide an 'envelope' of change such as crescendo or decrescendo of volume, or perhaps a moving pan of the sound from left channel to right channel over a period of time. These are all events that typically have overrun before and after the beginning and ending of the playing of notes. Overrun occurs because the well-known editing tools that are available allow you to draw an envelope, but generate a plurality of discrete events. Further, if no note is playing, it doesn't hurt to have a few extra events, such as 'volume change' events before the note starts playing.

In this document, controller events are used as an example, but other events may be used as well.

Controller events are a class of MIDI events that are used to set MIDI device-specific controls. There are 128 different possible controller events. Each controller event has a controller identifier that identifies the event as one of the 128 types and a value that ranges from 0 to 127. The MIDI specification defines approximately 25 of the 128 possible controller event types. For example, controller 7 is volume, controller 64 is the sustain pedal, controller 10 is left/right pan, etc. The approximately 100 undefined controller events are available for use by musical instruments. A musical instrument may define if and how it interprets a particular controller event.

In one embodiment of the present invention, text is sent to MIDI devices that expect and can interpret and make use of such text. Such text is termed public text. In this embodiment, an undefined controller event type is selected and defined to carry text information. Musical instruments may then be designed to detect the defined controller event type and interpret and use the text encoded in such events. The text-encoding controller events may occur anywhere in the MIDI datastream. Public text may, for example, be used to display text messages to the operator of a musical instrument during a performance.

In another embodiment of the present invention, text is hidden in the MIDI datastream. Such text is termed private or hidden text. In this embodiment, text is encoded in controller events in such a way that musical instruments do not detect that text is present and do not interpret or use the text. Private text may be used by a user that generates a MIDI data file to include in information that is to be decodable only by the user. Private text is not only not decodable by any other user or musical instrument, but preferably, other users or musical instruments cannot even detect the presence of private text.

Figure 8:
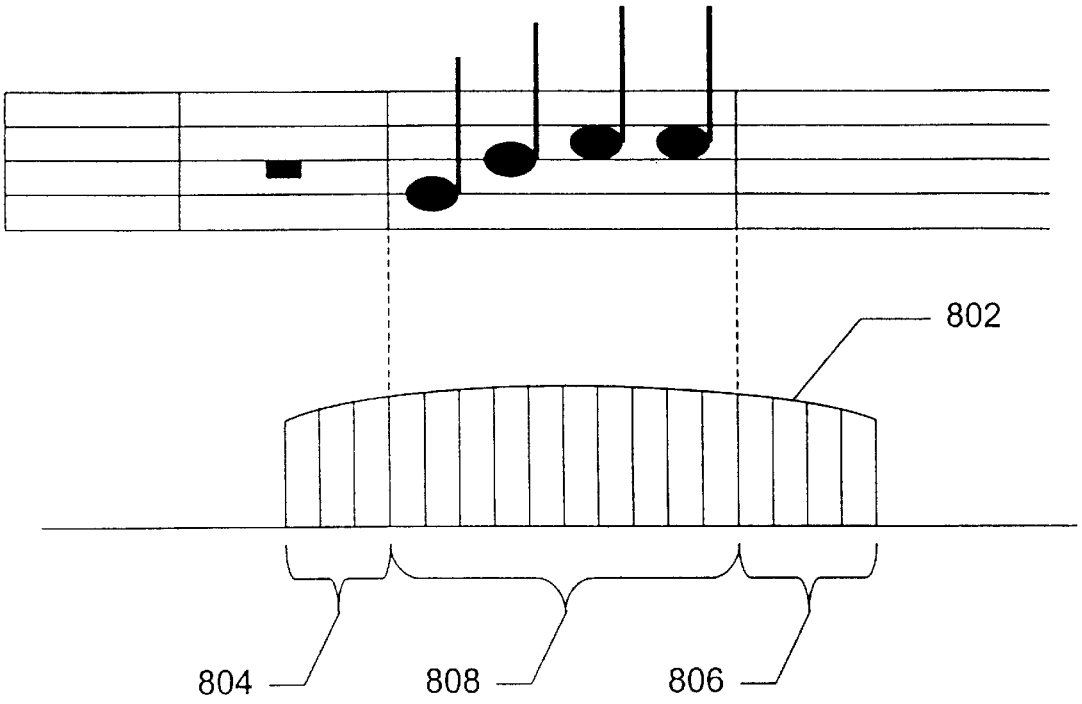
FIG. 8 is an example of a controller event envelope including overrun events.

As shown in FIG. 8 a program, such as MIDI editor software, allows a user to define envelopes 802 of controller events for any controller. A MIDI datastream output from such a program may include controller events before notes start 804, or after notes finish 806, in addition to controller events while notes are playing 808. Controller events that occur before notes start 804 or after notes finish 806 are termed overrun events and have no affect on the music that is played by a musical instrument. In this embodiment, the controller events that are used to encode text are transmitted as overrun events and are standard, commonly used events. Musical instruments that receive such events will interpret them as standard controller events, rather than as encoded text. The presence of controller events that encode private text is masked by secreting such events among the large number of other controller events that are present anyway.

Figure 3:
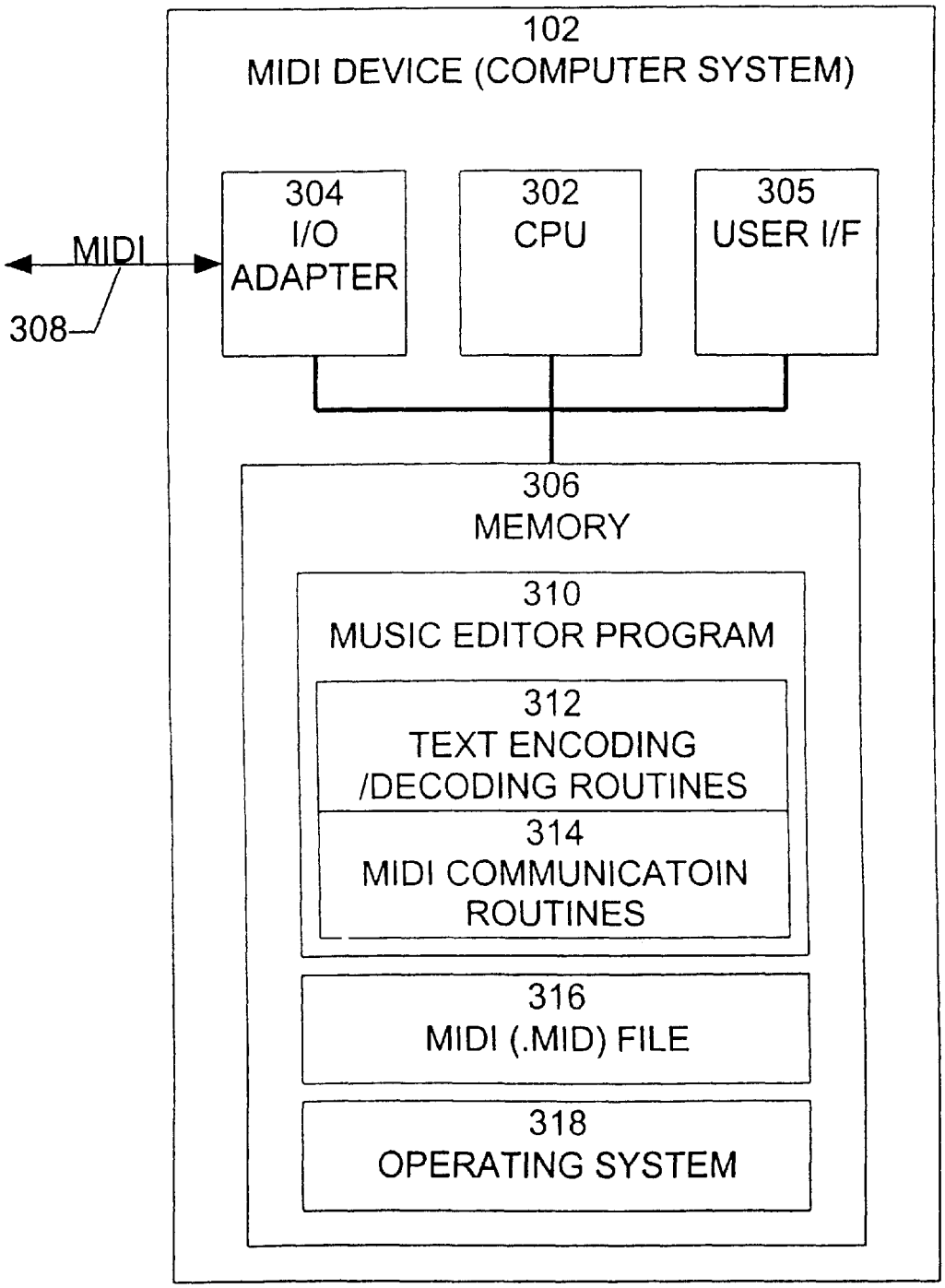
FIG. 3 is a block diagram of an exemplary MIDI device shown in FIG. 1.

An exemplary computer system 104 that generates MIDI files including encoded text, according to the present invention, is shown in FIG. 3. System 300 includes central processing unit (CPU) 302, which is connected to input/output (I/O) adapter 304, user interface 305 and memory 306. I/O adapter 302 couples system 300 to other MIDI devices connected to MIDI bus 308, allowing MIDI data communications with those MIDI devices. I/O adapter 302 includes well-known standard MIDI interface circuitry. User interface 305 accepts input from a user and displays output generated by system 300 to the user. User interface 305 typically includes a mouse, keyboard and monitor, but may also include other devices, such as a graphics tablet, trackpad, trackball, scanner, printer, etc.

Memory 306 is accessible by CPU 304 and stores program instructions executed by CPU 304 and data used during program execution. Memory 306 typically includes devices such as random-access memory (RAM), read-only memory (ROM), programmable read-only memory (PROM), erasable programmable read-only memory (EPROM), electrically erasable programmable read-only memory (EEPROM), and storage devices, such as hard disk drives, floppy disk drives, tape drives, optical drives, etc.

Memory 306 includes music program 310, text encoding/decoding routines 312, MIDI communication routines 314, MIDI file 316, and operating system 318. Music editor program 310 allows a user to enter and edit musical notation and text and to control MIDI devices to play music based on the entered musical notation. Text encoding/decoding routines 312 and MIDI communication routines 314 are typically included in music editor program 310. Text encoding/decoding routines 312 encode text into a MIDI datastream and decode text from a MIDI data stream. MIDI communication routines 314 control the transmission and reception of MIDI data from MIDI devices connected to MIDI bus 307.

Figure 4:
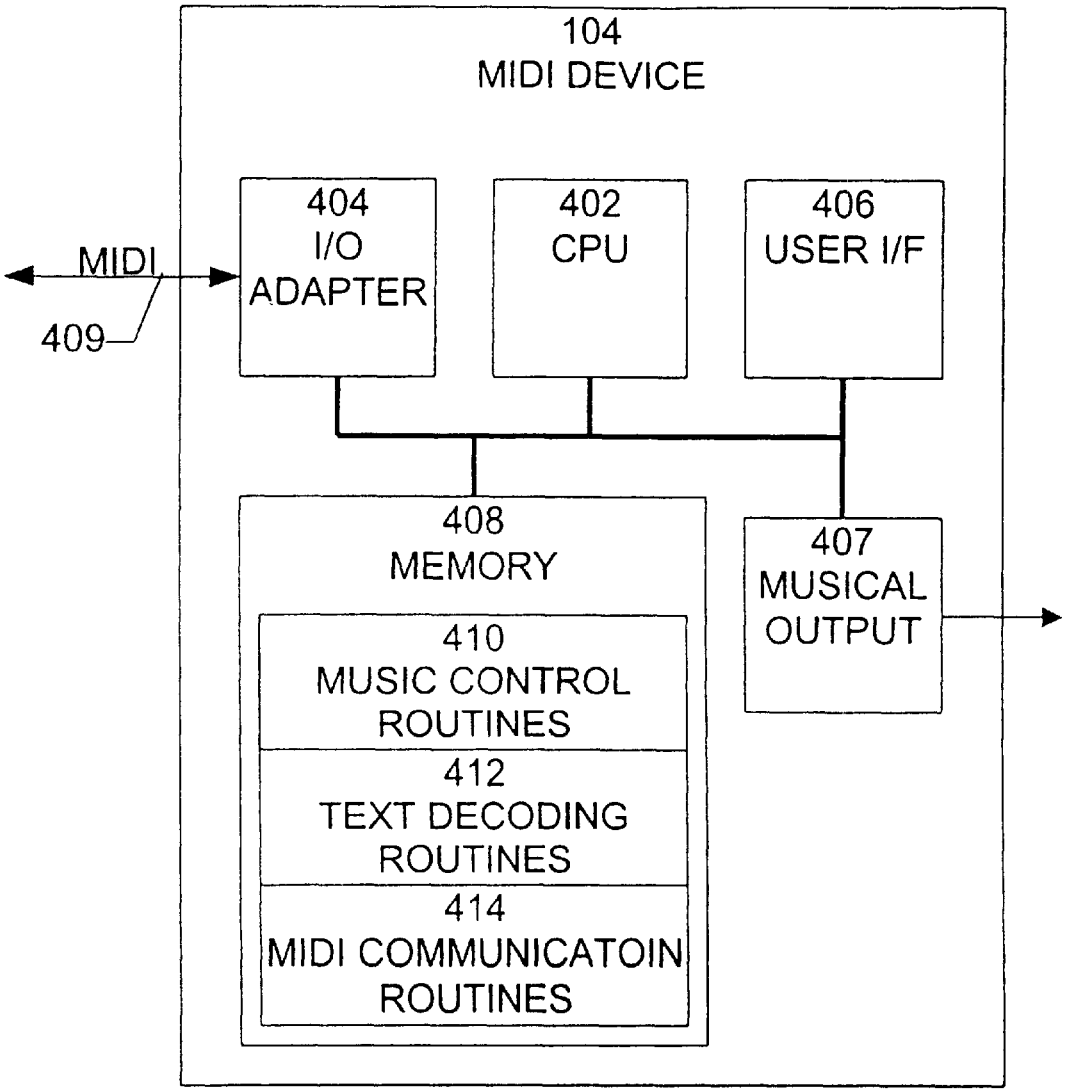
FIG. 4 is a block diagram of another exemplary MIDI device also shown in FIG. 1.

An exemplary MIDI device 102 that decodes and displays MIDI data including encoded text, according to the present invention, is shown in FIG. 4. Device 102 includes central processing unit (CPU) 402, which is connected to input/output (I/O) adapter 404, user interface 406, musical output circuitry 407 and memory 408. I/O adapter 402 couples system 400 to other MIDI devices connected to MIDI bus 409, allowing MIDI data communications with those MIDI devices. I/O adapter 402 includes well-known standard MIDI interface circuitry. User interface 406 accepts input from a user and displays output generated by system 400 to the user. User interface 406 typically includes devices such as a keyboard, drum pad, switches, sliders, etc., and a text display. Musical output circuitry 407 generates musical output signals based on the input MIDI datastream and/or user inputs.

Memory 408 is accessible by CPU 404 and stores program instructions executed by CPU 404 and data used during program execution. Memory 408 typically includes devices such as random-access memory (RAM), read-only memory (ROM), programmable read-only memory (PROM), erasable programmable read-only memory (EPROM), and electrically erasable programmable read-only memory (EEPROM), but may also include storage devices, such as hard disk drives, floppy disk drives, tape drives, optical drives, etc.

Memory 408 includes music control routines 410, text decoding routines 412, and MIDI communication routines 414. Music control routines 410 control musical output circuitry 407 in the generation of musical output signals based on the input MIDI datastream and/or user inputs. Text decoding routines 412 decode text encoded in a MIDI datastream received by device 102. MIDI communication routines 414 control the transmission and reception of MIDI data from MIDI devices connected to MIDI bus 409.

Figure 5:
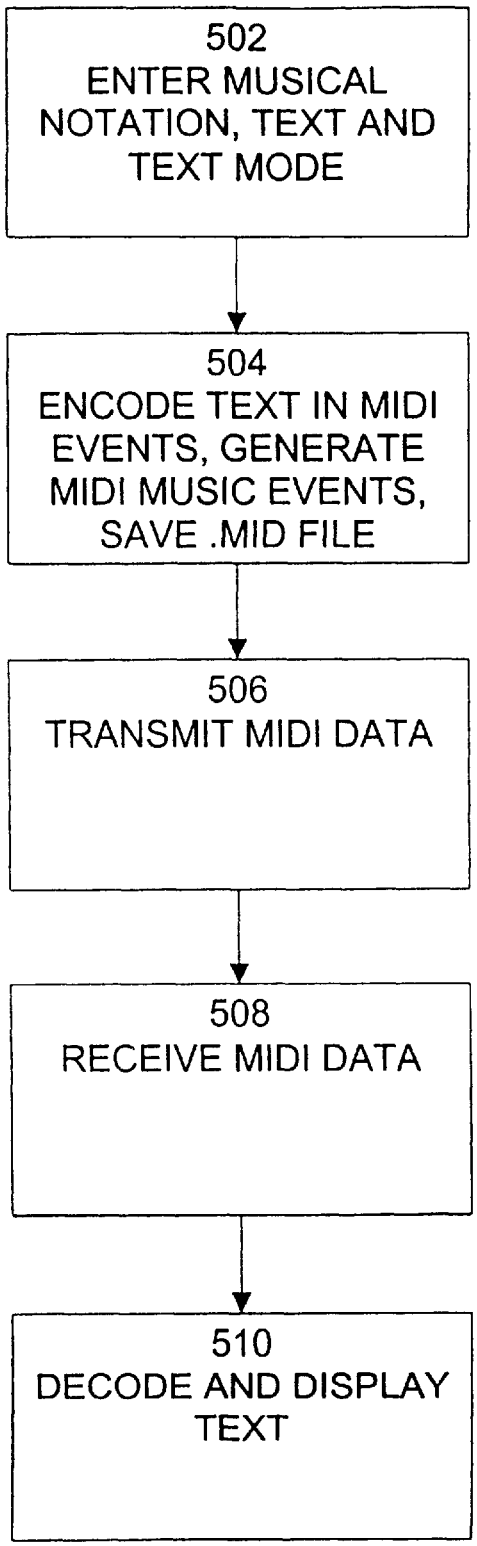
FIG. 5 is a flow diagram of a process of operation of the system shown in FIG. 1.

The system shown in FIG. 1 operates as shown in FIG. 5. In step 502, a user enters musical notation, text, and the mode in which the text is to be encoded using music editor program 310. In step 504, music editor program 310 invokes text encoding/decoding routines 312 to encode the entered text in MIDI events. Music editor program 310 also uses the entered musical notation to generate MIDI musical events. The musical events and the encoded text events are combined to form a MIDI data file 316, which is saved in memory 306. If the user has selected to encode the text as private or hidden text, the text is encoded in standard event type, such as a controller event type, which is defined in the MIDI standard. Only overrun events or other events that have no affect on the musical output of the musical instrument are used to encode text. If the user has selected to encode the text as public text, a non-standard event type, such as a controller event type, which is not defined in the MIDI standard, is used to encode text. The particular controller event type that is selected may depend upon the particular musical instrument being used and must be of a type that the musical instrument expects to encode text.

In step 506, music editor program 310 invokes MIDI communication routines 314 to transmit the data in MIDI file 316 to one or more MIDI devices connected to MIDI bus 307. In step 508, each such MIDI device receives the MIDI data stream transmitted from system 300. In step 510, if the text is public text, each MIDI device decodes the encoded text addressed to it and displays the text.

Figure 6:
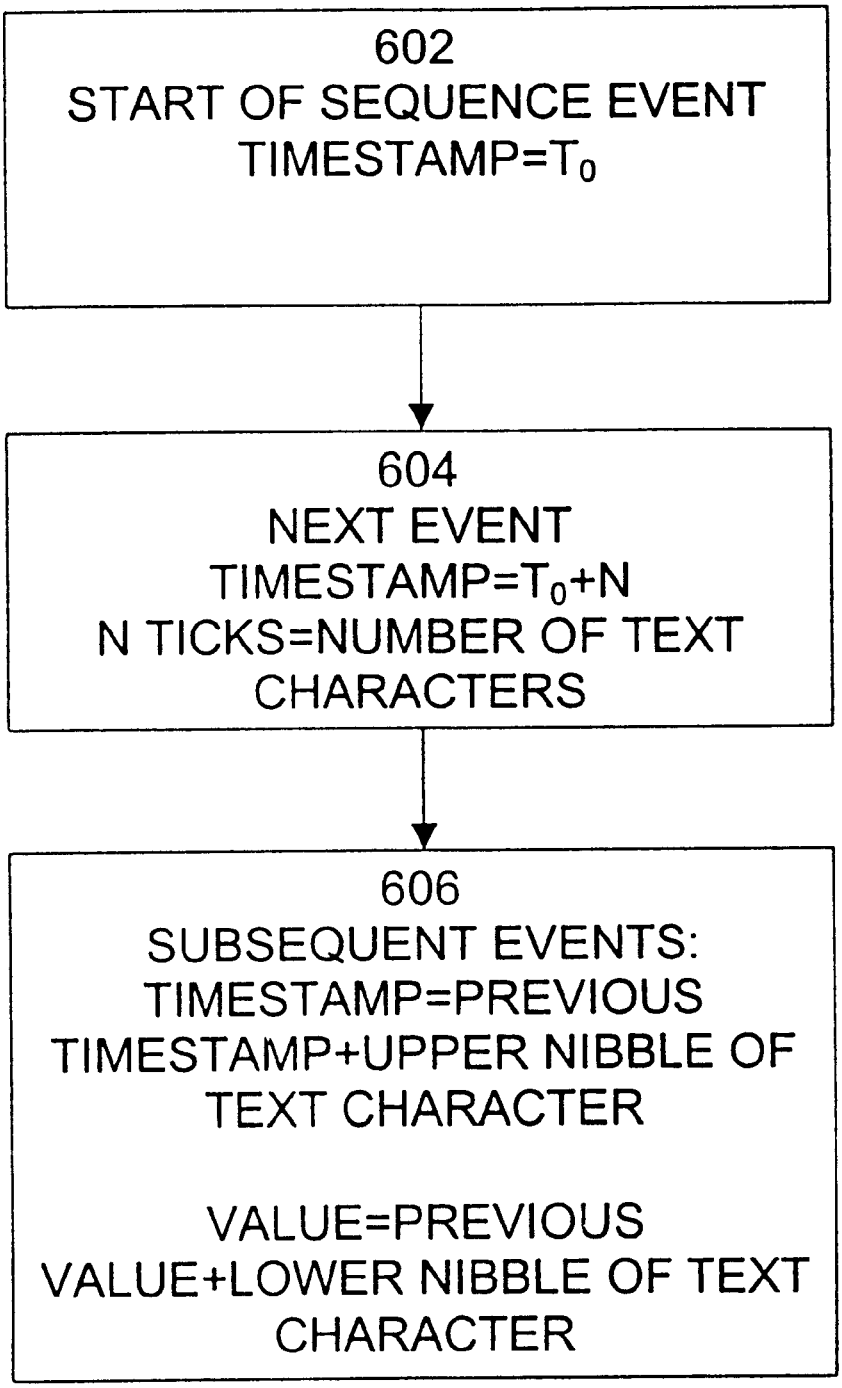
FIG. 6 is a flow diagram of an encoding process implemented in the device shown in FIG. 3.

An exemplary process in which text is encoded into a MIDI datastream, according to the present invention, is shown in FIG. 6. In step 602, a start of sequence MIDI event is generated. The start of sequence event has starting timestamp denoted $T_0$. In step 604, a next MIDI event is generated. The next event has a timestamp equal to $T_0$+N ticks, where N is equal to the number of text characters that are to be encoded in the MIDI datastream. In step 606, N subsequent MIDI events, one per encoded character, are generated. Each subsequent MIDI event has a timestamp equal to the timestamp of the previous MIDI event plus the upper nibble of the text character being encoded by the MIDI event. Likewise, each subsequent MIDI event has a value equal to the value of the previous MIDI event plus the lower nibble of the text character being encoded by the MIDI event.

Figure 7:
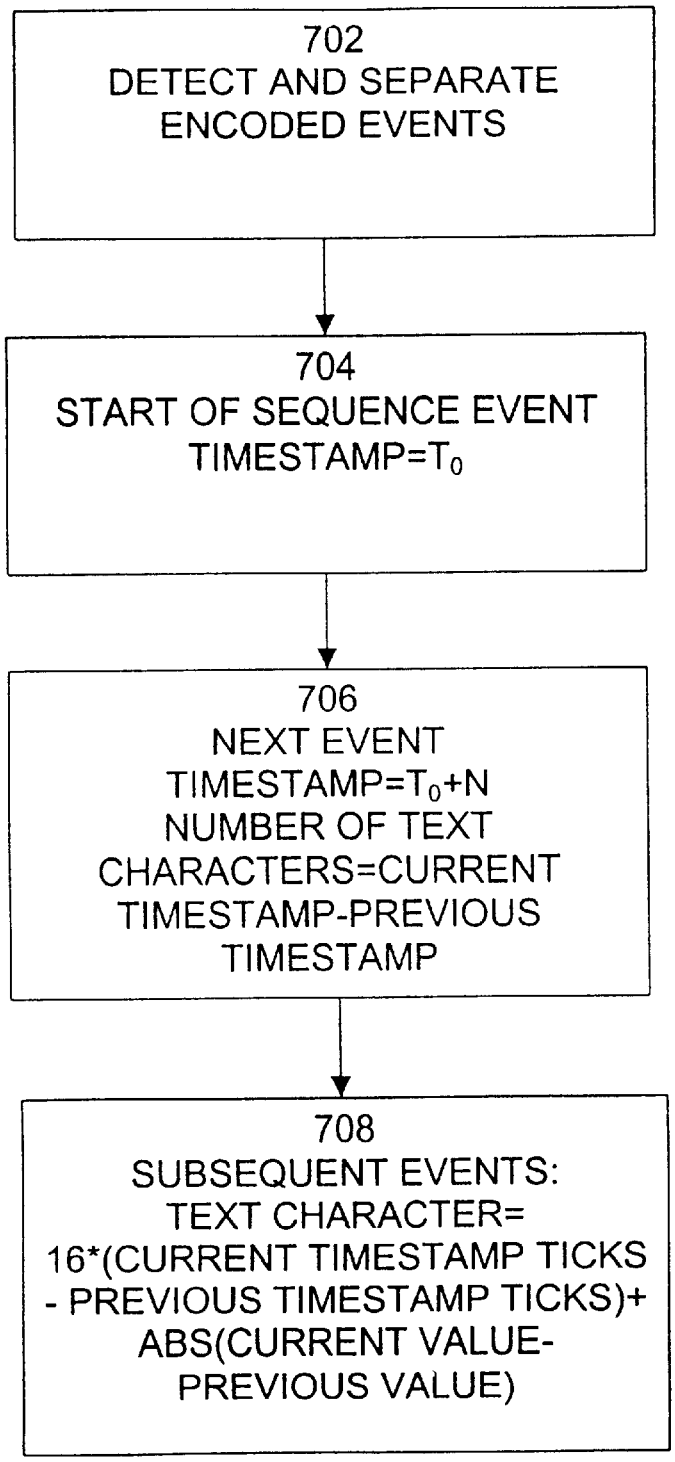
FIG. 7 is a flow diagram of a decoding process implemented in the devices shown in FIGS. 3 and 4.

An exemplary process in which a MIDI datastream, which includes text encoded according to the process shown in FIG. 6, is decoded, according to the present invention, is shown in FIG. 7. In step 702, the receiving MIDI device scans for and detects MIDI events that encode text data. If the encoded text is public text, the scan is performed by detecting the type of MIDI event that has been selected from among unused available controller event types and has been defined for use to encode public text data. If the encoded text is private text, additional information is needed in order to detect the encoded text sequences. For example, the starting and ending locations of the controller events that encode private text may be used to detect the relevant events. The controller events that encode private text cannot be detected by anyone without such information, so the encoded private text cannot be viewed, altered, or removed without authorization. The detected encoded events are separated from the other events in the MIDI datastream. The other MIDI events may be used to control the musical performance of the MIDI device. In step 704, a start of sequence MIDI event is detected. The start of sequence event has starting timestamp denoted $T_0$. In step 706, a next MIDI event is detected. The next event has a timestamp equal to $T_0$+N ticks, where N is equal to the number of text characters that are encoded in the MIDI datastream. The number of encoded text characters is determined by subtracting the previous timestamp value, which is the timestamp value of the start-of-sequence MIDI event, $T_0$, from the current timestamp value, which is the timestamp value of the next MIDI event, $T_0$+N, to yield N. In step 708, N subsequent MIDI events, one per encoded character, are detected. Each subsequent MIDI event has a timestamp equal to the timestamp of the previous MIDI event plus the upper nibble of the text character being encoded by the MIDI event. Likewise, each subsequent MIDI event has a value equal to the value of the previous MIDI event plus the lower nibble of the text character being encoded by the MIDI event. Thus, for each subsequent MIDI event, a decoded text character is recovered according to the relation:

Text character=16*(current timestamp ticks−previous timestamp ticks)+absolute value(current MIDI event value−previous MIDI event value).

It is important to note that while the present invention has been described in the context of a fully functioning data processing system, those of ordinary skill in the art will appreciate that the processes of the present invention are capable of being distributed in the form of a computer readable medium of instructions and a variety of forms ant that the present invention applies equally regardless of the particular type of signal bearing media actually used to carry out the distribution. Examples of computer readable media include recordable-type media such as floppy disc, a hard disk drive, RAM, and CD-ROM's, as well as transmission-type media, such as digital and analog communications links.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

What is claimed is:

1. A method of communicating text data over a Musical Instrument Digital Interface (MIDI), comprising the steps of:

receiving the text data;

encoding the text data to generate a plurality of MIDI events not including a standard MIDI text event; and transmitting the generated MIDI events.

2. The method of claim 1, wherein the encoding step comprises the steps of:

selecting a standard type of MIDI event; and generating a plurality of MIDI events of the selected type that encode the text data, the generated MIDI events include controller events which encode text and do not influence musical output.

3. The method of claim 1, wherein the encoding step comprises the steps of:

selecting a non-standard type of MIDI event; and generating a plurality of MIDI events of the selected type that encode text data.

4. The method of claim 1, further comprising the steps of:

receiving musical notation information;

converting the musical notation information to generate a plurality of MIDI events;

combining the MIDI events generated by encoding text data with the MIDI events generated by converting the musical notation information to generate a MIDI datastream; and transmitting the MIDI datastream.

5. The method of claim 1, wherein the type of the MIDI event is selected from among a set of MIDI event types consisting of: Key aftertouch, controller, Program Change, Channel Aftertouch, Pitch Bend Change, and System events.

6. The method of claim 1, wherein the text data comprises a plurality of text characters having a number and the encoding step comprises the steps of:

generating a start of sequence MIDI event having a first timestamp value;

generating a next MIDI event having a second timestamp value equal to the first timestamp value plus a number of ticks equal to the number of text characters of the text data; and generating a plurality of subsequent MIDI events, each subsequent MIDI event encoding one of the number of text characters.

7. The method of claim 6, wherein the step of generating a plurality of subsequent MIDI events comprises the steps of:

generating, for each of the number of text characters, a subsequent MIDI event having a timestamp value equal to a timestamp value of a previous MIDI event plus a number of ticks equal to a number represented by an upper nibble of the text character and having an event value equal to a previous event value plus a number of ticks equal to a number represented by a lower nibble of the text character.

8. The method of claim 6, wherein the step of generating a plurality of subsequent MIDI events comprises the steps of:

generating, for each of the number of text characters, a subsequent MIDI event having a timestamp value equal to a timestamp value of a previous MIDI event plus a number of ticks equal to a number represented by the four adjacent bits of a byte having the highest bit significance of the text character and having an event value equal to a previous event value plus a number of ticks equal to a number represented by the four adjacent bits of a byte having the lowest bit significance of the text character.

9. A method of communicating text data over a Musical Instrument Digital Interface (MIDI), comprising the steps of:

receiving a MIDI datastream;

detecting in the MIDI datastream a plurality of MIDI events that encode text data, the plurality of MIDI events not including a standard MIDI text event; and decoding the plurality of MIDI events that encode text data to recover the text data.

10. The method of claim 9, wherein the plurality of MIDI events that encode text data were generated by performing the steps of:

selecting a standard type of MIDI event; and generating a plurality of MIDI events of the selected type that encode the text data, the generated MIDI events include controller events which encode text and do not influence musical output.

11. The method of claim 9, wherein the plurality of MIDI events that encode text data were generated by performing the steps of:

selecting a non-standard type of MIDI event; and generating a plurality of MIDI events of the selected type that encode text data.

12. The method of claim 9, further comprising the steps of:

using at least some of the MIDI events in the MIDI datastream that do not encode text data to control a musical performance of a MIDI device.

13. The method of claim 9, wherein the type of the MIDI event is selected from among a set of MIDI event types consisting of: Key aftertouch, controller, Program Change, Channel Aftertouch, Pitch Bend Change, and System events.

14. The method of claim 13, wherein the text data comprises a plurality of text characters having a number and the decoding step comprises the steps of:

detecting a start of sequence MIDI event having a first timestamp value;

detecting a next MIDI event having a second timestamp value generating the number of encoded text characters based on the first timestamp value minus the second timestamp value; and decoding a plurality of subsequent MIDI events, each subsequent MIDI event encoding one of the number of text characters.

15. The method of claim 14, wherein the step of decoding a plurality of subsequent MIDI events comprises the steps of:

generating, for each subsequent MIDI event, a text character having an upper nibble equal to a timestamp value of the subsequent MIDI event minus the timestamp value of a previous MIDI event and having a lower nibble equal to an event value of the subsequent MIDI event minus an event value of the previous MIDI event.

16. The method of claim 14, wherein the step of generating a plurality of subsequent MIDI events comprises the steps of:

generating, for each of the number of text characters, a subsequent MIDI event having a timestamp value equal to a timestamp value of a previous MIDI event plus a number of ticks equal to a number represented by the four adjacent bits of a byte having the highest bit significance of the text character and having an event value equal to a previous event value plus a number of ticks equal to a number represented by the four adjacent bits of a byte having the lowest bit significance of the text character.

17. A method of communicating text data over a Musical Instrument Digital Interface (MIDI), comprising the steps of:

receiving the text data;

encoding the text data to generate a plurality of MIDI events not including a standard MIDI text event;

transmitting the generated MIDI events;

receiving the transmitted MIDI events;

detecting among the received MIDI events a plurality of MIDI events that encode text data; and decoding the plurality of MIDI events that encode text data to recover the text data.

18. The method of claim 17, wherein the encoding step comprises the steps of:

selecting a standard type of MIDI event; and generating a plurality of MIDI events of the selected type that encode the text data, the generated MIDI events include controller events which encode text and do not influence musical output.

19. The method of claim 17, wherein the encoding step comprises the steps of:

selecting a non-standard type of MIDI event; and generating a plurality of MIDI events of the selected type that encode text data.

20. The method of claim 17, further comprising the steps of:

receiving musical notation information;

converting the musical notation information to generate a plurality of MIDI events;

combining the MIDI events generated by encoding text data with the MIDI events generated by converting the musical notation information to generate a MIDI datastream; and using at least some of the MIDI events in the MIDI datastream that were generated by converting the musical notation information to control a musical performance of a MIDI device.

21. The method of claim 17, wherein the type of the MIDI event is selected from among a set of MIDI event types consisting of: Key aftertouch, controller, Program Change, Channel Aftertouch, Pitch Bend Change, and System events.

22. The method of claim 17, wherein the text data comprises a plurality of text characters having a number and the encoding step comprises the steps of:

generating a start of sequence MIDI event having a first timestamp value;

generating a next MIDI event having a second timestamp value equal to the first timestamp value plus a number of ticks equal to the number of text characters of the text data; and generating a plurality of subsequent MIDI events, each subsequent MIDI event encoding one of the number of text characters.

23. The method of claim 22, wherein the decoding step comprises the steps of:

detecting a start of sequence MIDI event having a first timestamp value;

detecting a next MIDI event having a second timestamp value generating the number of encoded text characters based on the first timestamp value minus the second timestamp value; and decoding a plurality of subsequent MIDI events, each subsequent MIDI event encoding one of the number of text characters.

24. The method of claim 23, wherein the step of generating a plurality of subsequent MIDI events comprises the steps of:

generating, for each of the number of text characters, a subsequent MIDI event having a timestamp value equal to a timestamp value of a previous MIDI event plus a number of ticks equal to a number represented by an upper nibble of the text character and having an event value equal to a previous event value plus a number of ticks equal to a number represented by a lower nibble of the text character.

25. The method of claim 23, wherein the step of generating a plurality of subsequent MIDI events comprises the steps of:

generating, for each of the number of text characters, a subsequent MIDI event having a timestamp value equal to a timestamp value of a previous MIDI event plus a number of ticks equal to a number represented by the four adjacent bits of a byte having the highest bit significance of the text character and having an event value equal to a previous event value plus a number of ticks equal to a number represented by the four adjacent bits of a byte having the lowest bit significance of the text character.

26. The method of claim 24, wherein the step of decoding a plurality of subsequent MIDI events comprises the steps of:

generating, for each subsequent MIDI event, a text character having an upper nibble equal to a timestamp value of the subsequent MIDI event minus the timestamp value of a previous MIDI event and having a lower nibble equal to an event value of the subsequent MIDI event minus an event value of the previous MIDI event.

27. The method of claim 24, wherein the step of generating a plurality of subsequent MIDI events comprises the steps of:

generating, for each of the number of text characters, a subsequent MIDI event having a timestamp value equal to a timestamp value of a previous MIDI event plus a number of ticks equal to a number represented by the four adjacent bits of a byte having the highest bit significance of the text character and having an event value equal to a previous event value plus a number of ticks equal to a number represented by the four adjacent bits of a byte having the lowest bit significance of the text character.

28. An apparatus for communicating text data over a Musical Instrument Digital Interface (MIDI), comprising:

means for receiving the text data;

means for encoding the text data to generate a plurality of MIDI events not including a standard MIDI text event; and means for transmitting the generated MIDI events.

29. The apparatus of claim 28, wherein the encoding means comprises:

means for generating a plurality of MIDI events that encode the text data of a selected standard type of MIDI event type, the generated MIDI events include controller events which encode text and do not influence musical output.

30. The method of claim 28, wherein the encoding means comprises:

means for generating a plurality of MIDI events that encode text data of a selected non-standard type of MIDI event.

31. The apparatus of claim 28, wherein the text data comprises a plurality of text characters having a number and the encoding means comprises:

means for generating a start of sequence MIDI event having a first timestamp value;

means for generating a next MIDI event having a second timestamp value equal to the first timestamp value plus a number of ticks equal to the number of text characters of the text data; and means for generating a plurality of subsequent MIDI events, each subsequent MIDI event encoding one of the number of text characters.

32. An apparatus for communicating text data over a Musical Instrument Digital Interface (MIDI), comprising:

means for receiving a MIDI datastream;

means for detecting in the MIDI datastream a plurality of MIDI events not including a standard MIDI text event; and means for decoding the plurality of MIDI events that encode text data to recover the text data.

33. The apparatus of claim 32, wherein the MIDI events that encode text data were generated by performing the steps of:

selecting a standard type of MDI event; and generating a plurality of MIDI events of the selected type that encode the text data, the generated MIDI events include controller events which encode text and do not influence musical output.

34. The method of claim 32, wherein the plurality of MIDI events that encode text data were generated by performing the steps of:

selecting a non-standard type of MIDI event; and generating a plurality of MIDI events of the selected type that encode text data.

35. The apparatus of claim 32, wherein the text data comprises a plurality of text characters having a number and the decoding means comprises:

means for detecting a start of sequence MIDI event having a first timestamp value;

means for detecting a next MIDI event having a second timestamp value means for generating the number of encoded text characters based on the first timestamp value minus the second timestamp value; and means for decoding a plurality of subsequent MIDI events, each subsequent MIDI event encoding one of the number of text characters.

36. A system for communicating text data over a Musical Instrument Digital Interface (MIDI), comprising:

means for receiving the text data;

means for encoding the text data to generate a plurality of MIDI events not including a standard MIDI text event, a type of the plurality of MIDI events selected from among those MIDI event types that do not always affect a musical output;

means for transmitting the generated MIDI events.

means for receiving the transmitted MIDI events;

means for detecting among the received MIDI events a plurality of MIDI events that encode text data; and means for decoding the plurality of MIDI events that encode text data to recover the text data.

37. The system of claim 36, wherein the text data comprises a plurality of text characters having a number and the encoding means comprises:

means for generating a start of sequence MIDI event having a first timestamp value;

means for generating a next MIDI event having a second timestamp value equal to the first timestamp value plus a number of ticks equal to the number of text characters of the text data; and means for generating a plurality of subsequent MIDI events, each subsequent MIDI event encoding one of the number of text characters.

38. The system of claim 37, wherein the decoding means comprises:

means for detecting a start of sequence MIDI event having a first timestamp value;

means for detecting a next MIDI event having a second timestamp value means for generating the number of encoded text characters based on the first timestamp value minus the second timestamp value; and means for decoding a plurality of subsequent MIDI events, each subsequent MIDI event encoding one of the number of text characters.

39. A computer program product for operating an apparatus for communicating text data over a Musical Instrument Digital Interface (MIDI), comprising:

a computer readable medium;

computer program instructions, recorded on the computer readable medium, executable by a processor, for performing the steps of:

receiving the text data;

encoding the text data to generate a plurality of MIDI events not including a standard MIDI text event; and transmitting the generated MIDI events.

40. The computer program product of claim 39, wherein the encoding step comprises the steps of:

selecting a standard type of MIDI event; and generating a plurality of MIDI events of the selected type that encode the text data, the generated MIDI events include controller events which encode text and do not influence musical output.

41. The computer program product of claim 39, wherein the encoding step comprises the steps of:

selecting a non-standard type of MIDI event; and generating a plurality of MIDI events of the selected type that encode text data.

42. The computer program product of claim 39, wherein the text data comprises a plurality of text characters having a number and the encoding step comprises the steps of:

generating a start of sequence MIDI event having a first timestamp value;

generating a next MIDI event having a second timestamp value equal to the first timestamp value plus a number of ticks equal to the number of text characters of the text data; and generating a plurality of subsequent MIDI events, each subsequent MIDI event encoding one of the number of text characters.

43. A computer program product for operating an apparatus for communicating text data over a Musical Instrument Digital Interface (MIDI), comprising:

a computer readable medium;

computer program instructions, recorded on the computer readable medium, executable by a processor, for performing the steps of:

receiving a MIDI datastream;

detecting in the MIDI datastream a plurality of MIDI events not including a standard MIDI text event; and decoding the plurality of MIDI events that encode text data to recover the text data.

44. The computer program product of claim 43, wherein the plurality of MIDI events that encode text data were generated by performing the steps of:

selecting a standard type of MIDI event; and generating a plurality of MIDI events of the selected type that encode the text data, the generated MIDI events include controller events which encode text and do not influence musical output.

45. The computer program product of claim 43, wherein the plurality of MIDI events that encode text data were generated by performing the steps of:

selecting a non-standard type of MIDI event; and generating a plurality of MIDI events of the selected type that encode text data.

46. The computer program product of claim 43, wherein the text data comprises a plurality of text characters having a number and the decoding step comprises the steps of:

detecting a start of sequence MIDI event having a first timestamp value;

detecting a next MIDI event having a second timestamp value generating the number of encoded text characters based on the first timestamp value minus the second timestamp value; and decoding a plurality of subsequent MIDI events, each subsequent MIDI event encoding one of the number of text characters.

47. A computer program product for operating an apparatus for communicating text data over a Musical Instrument Digital Interface (MIDI), comprising:

a computer readable medium;

computer program instructions, recorded on the computer readable medium, executable by a processor, for performing the steps of:

receiving the text data;

encoding the text data to generate a plurality of MIDI events not including a standard MIDI text event;

transmitting the generated MIDI events;

receiving the transmitted MIDI events;

detecting among the received MIDI events a plurality of MIDI events that encode text data; and decoding the plurality of MIDI events that encode text data to recover the text data.

48. The computer program product of claim 47, wherein the encoding step comprises the steps of:

selecting a standard type of MIDI event; and generating a plurality of MIDI events of the selected type that encode the text data, the generated MIDI events include controller events which encode text and do not influence musical output.

49. The computer program product of claim 47, wherein the encoding step comprises the steps of:

selecting a non-standard type of MIDI event; and generating a plurality of MIDI events of the selected type that encode text data.

50. The computer program product of claim 47, wherein the text data comprises a plurality of text characters having a number and the encoding step comprises the steps of:

generating a start of sequence MIDI event having a first timestamp value;

generating a next MIDI event having a second timestamp value equal to the first timestamp value plus a number of ticks equal to the number of text characters of the text data; and generating a plurality of subsequent MIDI events, each subsequent MIDI event encoding one of the number of text characters.

51. The computer program product of claim 50, wherein the decoding step comprises the steps of:

detecting a start of sequence MIDI event having a first timestamp value;

detecting a next MIDI event having a second timestamp value generating the number of encoded text characters based on the first timestamp value minus the second timestamp value; and decoding a plurality of subsequent MIDI events, each subsequent MIDI event encoding one of the number of text characters.

52. A Musical Instrument Digital Interface (MIDI) datastream encoding text data, the datastream generated by performing the steps of:

receiving the text data;

encoding the text data to generate a plurality of MIDI events not including a standard MIDI text event; and transmitting the generated MIDI events.

53. The datasteam of claim 52, wherein the encoding step comprises the steps of:

selecting a standard type of MIDI event; and generating a plurality of MIDI events of the selected type that encode the text data, the generated MIDI events include controller events which encode text and do not influence musical output.

54. The datastream of claim 52, wherein the encoding step comprises the steps of:

selecting a non-standard type of MIDI event; and generating a plurality of MIDI events of the selected type that encode text data.

55. The datastream of claim 52, wherein the text data comprises a plurality of text characters having a number and the encoding step comprises the steps of:

generating a start of sequence MIDI event having a first timestamp value;

generating a next MIDI event having a second timestamp value equal to the first timestamp value plus a number of ticks equal to the number of text characters of the text data; and generating a plurality of subsequent MIDI events, each subsequent MIDI event encoding one of the number of text characters.

* * * * *